US007960007B2

(12) United States Patent
Lee

(10) Patent No.: US 7,960,007 B2
(45) Date of Patent: Jun. 14, 2011

(54) RETORTABLE LINERS AND CONTAINERS

(75) Inventor: Biing-Lin Lee, Cranston, RI (US)

(73) Assignee: Teknor Apex Company, Pawtucket, RI (US)

( * ) Notice: Subject to any disclaimer, the term of this patent is extended or adjusted under 35 U.S.C. 154(b) by 193 days.

(21) Appl. No.: 12/218,098

(22) Filed: Jul. 11, 2008

(65) Prior Publication Data

US 2010/0006532 A1 Jan. 14, 2010

(51) Int. Cl.
*B32B 3/02* (2006.01)
*B29D 22/00* (2006.01)

(52) U.S. Cl. ..... 428/66.4; 428/35.7

(58) Field of Classification Search ..... 428/35.7, 428/66.4; 524/505; 525/89; 215/341–350
See application file for complete search history.

(56) References Cited

U.S. PATENT DOCUMENTS

| | | | | |
|---|---|---|---|---|
| 4,807,772 | A | 2/1989 | Schloss | |
| 5,459,193 | A * | 10/1995 | Anderson et al. | 524/505 |
| 5,665,803 | A * | 9/1997 | Nohr et al. | 524/267 |
| 6,702,133 | B1 | 3/2004 | Shenkar et al. | |
| 7,055,713 | B2 | 6/2006 | Rea et al. | |
| 7,056,971 | B2 | 6/2006 | Varma | |
| 7,718,721 | B2 * | 5/2010 | Balfour et al. | 524/100 |
| 2003/0116524 | A1 | 6/2003 | Robinson et al. | |
| 2006/0286327 | A1 | 12/2006 | Crawford et al. | |
| 2007/0082096 | A1 | 4/2007 | Dougherty et al. | |
| 2007/0110984 | A1 * | 5/2007 | Reedy | 428/304.4 |

FOREIGN PATENT DOCUMENTS

| | | |
|---|---|---|
| EP | 0 380 269 | 8/1990 |
| EP | 0 659 655 | 6/1995 |
| EP | 1 845 027 | 10/2007 |
| GB | 1196125 | 6/1970 |
| JP | 11-180457 | 7/1999 |
| JP | 2004-224975 | 8/2004 |
| WO | WO 2008000493 A1 * | 1/2008 |

* cited by examiner

*Primary Examiner* — Rena L Dye
*Assistant Examiner* — James Yager
(74) *Attorney, Agent, or Firm* — Hudak, Shunk & Farine Co. LPA

(57) ABSTRACT

Retort liners and containers including a container body such as a bottle or jar, a closure, and the retort liner, wherein the retort liners exhibit attractive properties such as low compression set under retort conditions, desirable adhesion to a polymeric closure such as a cap or lid, and beneficial oxygen barrier properties. In particular, the retort liners are thermoplastic elastomers formed from compositions including one or more styrenic block copolymers, one or more polyolefins and a softener. In a preferred embodiment, the retortable containers are all plastic packages, wherein the bottle or jar and the closure are thermoplastic compositions and the liner is a thermoplastic elastomer composition.

30 Claims, 1 Drawing Sheet

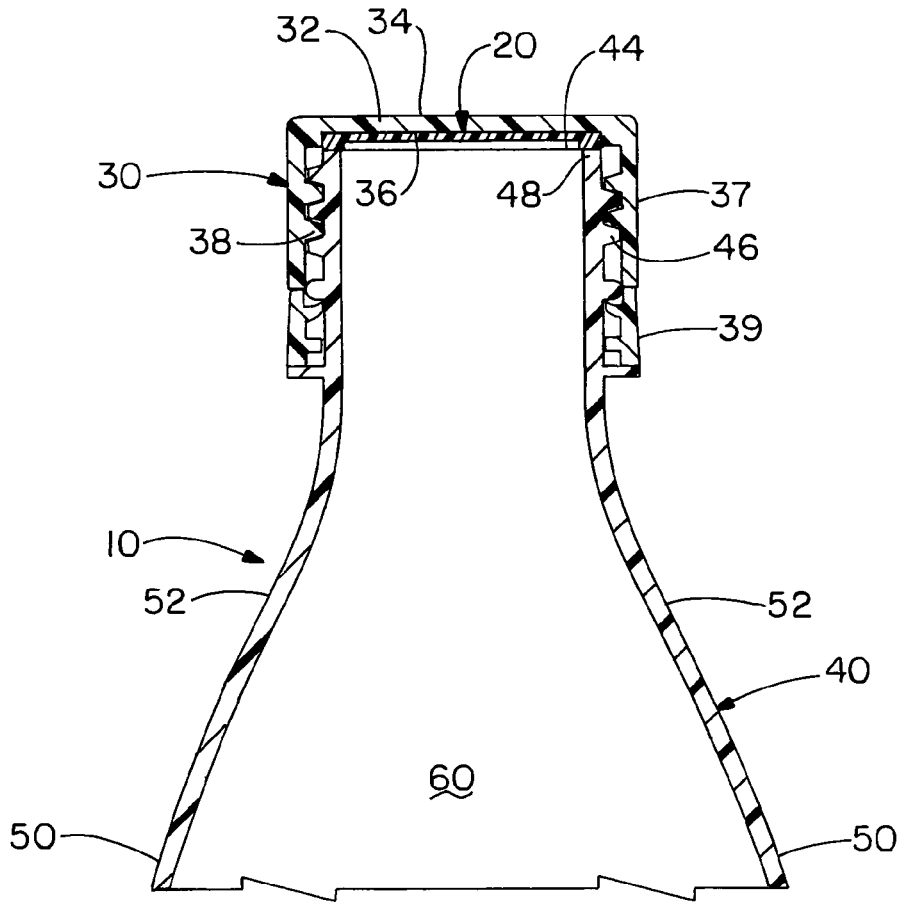
FIG.-1
FIG.-2
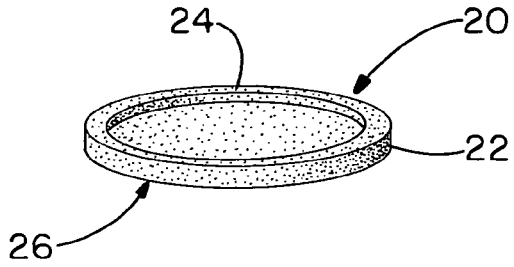

RETORTABLE LINERS AND CONTAINERS

FIELD OF THE INVENTION

The present invention relates to retort liners and containers including a container body such as a bottle or jar, a closure, and the retort liner, wherein the retort liners exhibit attractive properties such as low compression set under retort conditions, desirable adhesion to a polymeric closure such as a cap or lid, and beneficial oxygen barrier properties. In particular, the retort liners are thermoplastic elastomers formed from compositions including one or more styrenic block copolymers, one or more polyolefins and a softener. In a preferred embodiment, the retortable containers are all plastic packages, wherein the bottle or jar and the closure are thermoplastic compositions and the liner is a thermoplastic elastomer composition.

BACKGROUND OF THE INVENTION

Numerous items are packaged in sealed containers including products such as beverages, foodstuffs, nutritional products, medical products and generally any other items wherein it is desirable to keep the same from becoming spoiled or contaminated for a period of time. Various products are sterilized or heat treated after being sealed in a container such as by utilizing a retorting process in which the container that contains the food products is heated to relatively high temperatures such as in a range from about 121° C. to 132° C. or above. The containers can also be subjected to external pressurization during retorting to counteract an increase in internal pressure that can develop within the container as the contents are heated.

The retort process, while being an efficient heat treating or sterilizing process, can be harsh on container components because of the temperature and pressure variations which the container components are subjected to. Materials that are commonly used for reclosable containers such as plastic bottles can soften and distort during retort processing. Materials utilized for liners or seals can soften and lose sealability. As liner materials are generally separate components when compared to the container and closure, differences in materials can cause small gaps or pinholes to form at an interface of the components. Unwanted venting would allow products to escape the container as the pressure increases during the retort process and can allow process bath water when utilized to enter the container when internal pressure decreases relative to the external pressure and the container returns to an ambient condition.

Additional considerations are present when the container includes a threaded closure and a retort liner present between the closure and container body. An adequate seal must be maintained between the liner and container body, as well as the liner and the closure, and closure with the container body. These contact points can increase the number of possible manufacturing errors that can allow for product contamination.

The use of retort liners in sealing a container requires a liner that can withstand the retort process without failing, maintain a suitable oxygen barrier for a desired lifespan of the product and also be easily removable from the container when desired by a consumer. Some liners may adhere so tightly to a lip of the container that when the consumer attempts to remove a closure which contains a liner, a liner can tear into small pieces or can leave fragments along the container rim. Thereafter, the product may settle undesirably under the liner fragments, especially when the product is a beverage. Torn or broken liners can increase the probability of contamination of the product.

United Kingdom Patent No. 1,196,125 relates to sealing gaskets for container closures, e.g., of the crown, roll-on thread, pre-threaded screw and lug types, and to their formation.

U.S. Pat. No. 4,807,772 relates to a polypropylene compression molded closure with an elastomer liner that is removable, the elastomer being a blend of polyethylene and a rubbery copolymer, containing oil.

U.S. Pat. No. 6,702,133 relates to a retortable all-plastic closure having a generally circular top portion and a generally cylindrical downwardly depending skirt.

U.S. Pat. No. 7,055,713 relates to a retortable container and closure for hermetic sealing of an open end thereof. The closure includes a metal end ring adapted to be double seamed to an open end of the retortable container, an intermediate area extending radially inward and defining an opening to an interior of the container, and a folded area folded into the interior of the container. The folded area extends radially outward from the opening and substantially parallel to at least an adjacent portion of the intermediate area. A first membrane patch overlaps and is bonded to an under side of the intermediate area of the end ring such that the first membrane patch prevents contamination of contents of the container by the metal end. A second membrane patch covers the opening and is bonded to an upper side of the first membrane patch.

U.S. Pat. No. 7,056,971 relates to a thermoplastic elastomer sealant which is oxygen-permeable and reportedly provided with barrier properties against oxygen by melt-blending with a liquid polyisobutene oil plasticizer in an amount insufficient to render the plasticized elastomer tacky. If made tacky, enough detackifier is reportedly used to allow the product to be formed into a removable seal. The TPE may be a conventional thermoplastic vulcanizate or a block copolymer of a vinyl aromatic compound, typically styrene, and a conjugated diene, typically butadiene or isoprene, or mixtures thereof; the block may be a diblock, triblock or higher block, but the preferred polyblock copolymer is a triblock with styrene end-blocks and a butadiene/isoprene mid-block. Preferably the diene mid-block is hydrogenated to provide a poly (lower)-monoolefin mid-block. When the TPE is a TPV, some or all of the mineral oil used to make the TPV processable may also be substituted with the polyisobutene plasticizer. The elastomeric product is reportedly useful for sealing elements for containers in which foods, beverages and medical products must be preserved for a long period.

U.S. Patent Application Publication No. 2003/0116524 relates to a closure which reportedly provides a means for maintaining an effective pressure against a peelable seal affixed to a container lip as the sealed container is exposed to relatively high temperature and pressure conditions. The closure includes a liner which abuts a surface of the seal so as to sandwich the seal between the liner and the container lip. The liner defines a resting thickness at ambient temperature and pressure conditions and is made from a material reportedly capable of being compressed to a thickness less than the resting thickness and of recovering to a recovery thickness sufficient to allow the liner to maintain a positive pressure against the seal upon exposure to elevated temperatures, elevated pressure, or a combination of elevated temperature and elevated pressure.

U.S. Patent Application Publication No. 2006/0286327 relates to retort food containers comprising polyester compositions comprising polyesters which comprise a dicarboxylic acid component having terephthalic acid residues; optionally, aromatic dicarboxylic acid residues or aliphatic dicarboxylic acid residues or ester residues thereof; 2,2,4,4-tetramethyl-1,3-cyclobutanediol residues; and 1,4-cyclohexane-dimethanol residues.

European Patent Publication No. 0 380 269 relates to a method of treating a food container having a plastic body portion and a lid sealed thereto for the purpose of reportedly insuring that micro-organisms cannot penetrate into the interior of the container through any faults or imperfections in the seal between the lid and the body portion, which method comprises forming a polymeric coating layer over the external surface of the container in such a manner as to encompass completely the join between the lid and the body of the container, the resultant polymeric coating layer being a retortable polymer.

European Patent Publication No. 0 659 655 relates to a plastic closure for sealing containers which has been filled with contents that are hot or which are to be retorted. The closure is made of thermosetting or thermoplastic material. The closure includes a base wall and a peripheral skirt. The skirt is formed for engaging a container. The base wall of the closure having an inner surface with a liner thereon. A reaction hot melt adhesive bonds the liner to the inner surface. The reactive hot melt adhesive is cross-linkable such that after the liner is applied and the adhesive cures, the adhesive bonds the liner to the inner surface of the base wall of the closure such that the liner will reportedly withstand and resist deformation under vacuum caused by cooling of the hot contents in a container or caused by retorting the contents of a container and subsequent cooling. The reactive hot melt adhesive may be a cross-linkable adhesive selected from the group consisting of polyurethane and silicone. The liner being adhered may be made of ethylene, polypropylene, α-olefin copolymers, i.e., ethylene-octane, propylene-ethylene or butylene-ethylene and SBR rubber.

European Patent Publication No. 1 845 027 involves the use of plasticized PVC compounds to meet the difficult requirements relating to twist-off cap closures. Replacement of PVC compounds in the closure would reportedly enable the industry to take advantageous use of twist-off cap closures that do not have the drawbacks generated by the use of PVC. Further, this application relates to compositions for hermetic closures for receptacles and also to hermetic closures for carbonated-drink receptacles, which comprise the above compositions and which are designed so that their cap can easily be twisted off.

Japanese Publication No. 11-180457 relates to providing a cap with a sterilized filling liner which reportedly makes cap opening torque small in opening the cap while keeping a big cap fitting angle in closing the cap.

Japanese Publication No. 2004-224975 provides a composition for a cap liner material reportedly having excellent sealability, cap-openability, sanitariness and moldability and keeping good sealability and cap-openability even after the heat-treatment at a high temperature, and thus reportedly useful as a cap liner and a cap of various food containers and drink containers necessitating high-temperature sterilization such as retort treatment.

SUMMARY OF THE INVENTION

In view of the above, it is an object of the present invention to provide a retort liner that provides improved sealing capability and is adapted to maintain a desired seal during and after the liner and a container in contact with the liner is subjected to a retort process.

A further object of the present invention is to provide a container including a closure and a container body, wherein a retort liner is operatively connected between the closure and the container body for maintaining an effective seal of the container to prevent leakage. The retort liner provides an effective seal as the sealed container is subjected to temperature and pressure fluctuations during a retort process.

An additional object of the present invention is to provide an all-plastic container that is substantially free of metal and/or glass in a sealing area between container body and a closure with the closure also preferably being plastic that includes a retort liner connected thereto. In a preferred embodiment, the closure is threadable to seal the closure to the container body with the retort liner disposed in a sealing relationship between a portion of the closure and a portion of the container body.

Another object of the present invention is to provide a retort liner having the following properties: low compression set under retort conditions; desirable adhesion to a plastic closure, preferably a polypropylene plastic closure; desirable melt flow for compression molding and/or injection molding, preferably a melt index of about 10 to about 27 for compression molding, and a melt index greater than about 27 for injection molding when the retort liner is a seal ring, wherein the melt index is based on grams of polymer per 10 minutes measured according to ASTM D1238; and a reasonably low oxygen permeability.

Still another object of the present invention is to provide a retort liner composition comprising a relatively high melt viscosity styrenic block copolymer that provides good compression set to the liner and a low melt viscosity styrenic block copolymer, such as SIBS, that provides oxygen barrier properties or SEBS or a combination thereof.

Yet a further object of the present invention is to provide a retort liner including two or more thermoplastic polyolefins, with one of the polyolefins having a low melt index that provides a desired tensile strength and a polyolefin having a relatively high melt index that provides processability to the composition during formation of the liner.

When utilized in the present invention, unless stated otherwise, melt viscosity is measured at a shear rate of 4.6 1/s at 230° C. using a Kaynes capillary rheometer having a die diameter of 1.016 mm and a die length of 20.32 mm.

In one aspect of the present invention, a retort liner composition for use in sealing a retortable container is disclosed, comprising at least two styrenic block copolymers, including a first styrenic block copolymer having a melt viscosity greater than or equal to 60,000 Pa·s at a shear rate of 4.6 1/s at 230° C., and a second styrenic block copolymer having a melt viscosity less than the first styrenic block copolymer, wherein the at least two styrenic block copolymers each have at least one hard polymer block derived from at least two aromatic vinyl compound units, and at least one soft polymer block, wherein the soft polymer block includes at least one repeat unit derived from one or more of an olefin monomer and a diene monomer; a softener; and one or more polyolefin (co) polymers. In a preferred embodiment, the first styrenic block copolymer, a relatively high viscosity styrenic block copolymer, is SEBS (styrene-ethylene/butylene styrene block copolymer), and the second styrenic block copolymer, a low viscosity styrenic block copolymer, is SIBS (polystyrene-isobutylene block copolymer) that imparts processability and a barrier property.

In yet another aspect of the present invention, a retort liner composition for use in sealing a retortable container is disclosed, comprising one or more styrenic block copolymers, wherein the styrenic block copolymers each have at least one hard polymer block derived from at least two aromatic vinyl compound units and at least one soft polymer block, wherein the soft polymer block includes at least one repeat unit derived from one or more of an olefin monomer and a diene monomer; two or more polyolefin (co)polymers in a total amount of from about 35 to about 55 parts based on 100 total parts by weight of the styrenic block copolymer, wherein the first polyolefin (co)polymer has a melt index greater than 8 grams of polymer per 10 minutes measured according to ASTM D1238, and wherein the second polyolefin (co)polymer has a melt index from about 0.4 to 8 grams of polymer per 10 minutes measured according to ASTM D1238, and a softener.

In still another aspect of the present invention, a retortable container system is disclosed, comprising a polymeric container body having a base and sidewalls connected to the base forming a receptacle area, the container further having an opening, a polymeric closure adapted to seal the opening in the container and having a top portion with upper and lower surfaces, and a retort liner connected to the lower surface of the top portion of the closure and adapted to seal the container opening in a sealing position, the retort liner comprising (a) at least two styrenic block copolymers, including a first styrenic block copolymer having a melt viscosity greater than or equal to 60,000 Pa·s at a shear rate of 4.6 1/s at 230° C., and a second styrenic block copolymer having a melt viscosity less than the first styrenic block copolymer, wherein the styrenic block copolymer has at least one hard polymer block derived from at least two aromatic vinyl compound units, and at least one soft polymer block, wherein the soft polymer block includes at least one repeat unit derived from one or more of an olefin monomer and a diene monomer; a softener, one or more polyolefin (co)polymers, or (b) one or more styrenic block copolymers, wherein the styrenic block copolymer has at least one hard polymer block derived from at least two aromatic vinyl compound units, and has at least one soft polymer block, wherein the soft polymer block includes at least one repeat unit derived from one or more of an olefin monomer and a diene monomer; two or more polyolefin (co)polymers present in a total amount of from about 35 to about 55 parts based on 100 total parts by weight of the styrenic block copolymer, wherein the first polyolefin (co)polymer has a melt index greater than 7 grams of polymer per 10 minutes measured according to ASTM D1238, and wherein the second polyolefin (co)polymer has a melt index from about 0.4 to about 6 grams of polymer per 10 minutes measured according to ASTM D1238, and a softener.

The present invention achieves the desirable technological properties for use as a retortable seal or cap liner and other objects which will be become apparent from the description that follows.

BRIEF DESCRIPTION OF THE DRAWINGS

The invention will be better understood and other features and advantages will become apparent by reading the detailed description of the invention, taken together with the drawings, wherein:

FIG. 1 is a side elevational view schematically illustrating one embodiment of a container including a retortable liner of the present invention; and FIG. 2 is a side perspective view illustrating one embodiment of a retort liner of the present invention.

DETAILED DESCRIPTION OF THE INVENTION

Referring now to the Figures, one embodiment of a retortable container 10 is shown in FIG. 1 and a retort liner 20 is shown in FIG. 2. The container has a body 40 that is adapted to be filled with a beverage, foodstuff, or another desired item, and sealed with a closure 30, wherein a retort liner 20 is provided to seal an opening 44 in the container body 40. Preferably, the retort liner 20 is situated between the closure 30 and the opening 44 in the container body 40 in one embodiment, when the closure 30 is connected to the body 40.

The closure 30 of the container 10 is generally a cap or lid which, in a preferred embodiment, is adapted to have the liner adhered to a surface thereof, with or without the use of one or more adhesives. The closure 30 illustrated in FIG. 1 includes a generally annular or circular top portion 32 having an upper surface 34 and a lower surface 36, with the retort liner 20 being in contact with at least a portion of the lower surface 36. The closure 30 has a substantially cylindrical skirt 37 extending downwardly from the top portion and integrally formed therewith. The skirt includes an interior surface and an exterior surface, with the exterior surface being provided with ribs, protrusions or indentations in one embodiment which can aid in sealing the closure 30 to the container 10. In one embodiment, a thread 38 is formed in the inner wall of the skirt that mates with a thread 46 formed on the outer wall of the neck portion of the container body 40 shown in FIG. 1. Although threads are shown in the drawings and utilized in one preferred embodiment, those of ordinary skill in the art will recognize that other methods of securing the closure 30 and retort liner 20 contained therein to the container body 40 may also be utilized, such as a snap-on configuration. The thread 46 may have one of a variety of thread configurations, such as a single helix, double helix, triple helix, or other multiple helixes, as are known in the art.

In one embodiment of the present invention, a tamper evident band 39 may be formed on the lower portion of the skirt and may include ratchet teeth that engage mating ratchet teeth formed in the neck of the container.

In one embodiment, the retort liner 20 has a lower surface 26 adapted to contact a portion of the container body 40 and an upper surface 24 that abuts the top interior lower surface 36 of the closure and is sized to fit firmly within the closure. In one embodiment such as shown in FIG. 2, the diameter or peripheral edge 22 of the liner is large enough that the retort liner 20 can be held within the cap without the need for a bonding material. In other embodiments, the retort liner may be optionally adhered, if desired, such as on its upper surface 24, to the closure by a variety of means such as known in the art, for example a thin layer of adhesive, glue or similar bonding material. The composition of the liner should be sufficient that the material be pliable or elastic and can be compressed between the closure and the container, but also sufficiently resilient so that the material can recover from a compressed state and ambient temperature and pressure conditions as well as under stress temperature in pressure conditions, such as are present during a retort process. The retort liner should have sufficient elasticity so it can conform to any distortions in the container body, such as at the container lip 48, for example molding nubs or small divots or voids, or distortions in the closure. In some embodiments, the retort liner is a planar seal ring, and generally formed with a rim which is shown in FIG. 2.

The retortable container body comprises a base and outer side walls 50 extending upwardly from the base. The base and outer side walls define a void 60 in the body portion of the retort container for receiving one or more products such as described herein. In one embodiment, the outer side walls form shoulders 52 at an upper end which lead to a neck portion that terminates in an opening, defining lip 48 having a periphery. As shown in FIG. 1, the neck has an exterior portion adapted to allow the container body to receive and engage the closure. The configuration of the retort container body 40 illustrated in FIG. 1 is generally a bottle. It should be understood that retort containers useful in the present invention can be made in a variety of other configurations suitable for the particular application.

In the embodiment shown in FIG. 1, the closure 30 having the retort liner 20 attached thereto is removably connected to the container body 40 after the container body is filled. The container with contents therein is sterilized or heat treated utilizing a retort process. Various retort systems are known in the art, such as retort batch systems and retort continuous processes. Examples of further retort systems include continuous hydrostatic retort systems and continuous agitating retort systems. Both types of systems include a conveyor for carrying foodstuff packaged in containers, a container feeder for delivering packaged foodstuff to the conveyor, a retort chamber for treating the packaged foodstuff with elevated temperature and pressure, and a discharge system for discharging the retorted packaged foodstuff for further packaging and handling. The hydrostatic retort systems include water columns for maintaining elevated pressure in the retort chamber and agitating retort systems include agitators for agitating the foodstuff within its container as the packaged foodstuff travels through the retort system. Such continuous retort systems are often large and expensive and require a large capital investment for the packaged foodstuff manufacturer.

In a typical retort process, the filled container is transported through or placed in a high pressure overheated water bath, wherein the container is heated for a predetermined period of time, generally about 1 to about 50 minutes and preferably from about 1 to about 40 minutes at a temperature generally from about 121° C. (249° F.) to about 130° C. (266° F.) or more, and preferably from about 121° C. (249° F.) to 125° C. (257° F.). As the exterior surface of the container is heated, the packaged contents are heated and the internal pressure within the container increases. Concurrently, in one embodiment the container is submerged to greater depths in a water bath resulting in a counteracting external pressure increase. After the retorting process, the container is cooled, such as in a water bath. The rate of movement in the retort process and in subsequent cooling steps is designed to minimize variations in the internal pressure of the container. After a predetermined period of time, the container is removed from the retort system and allowed to cool to room temperature.

The retort liner cooperatively functions with the container body and the closure to provide an added measure of protection for seal integrity as the container contents are sterilized or heat treated by the retort process. More specifically, the retort liner functions cooperatively with the closure to provide a pressure against the container body, specifically the container lip. When the closure is attached to the container body at ambient temperature and pressure conditions, the closure may be tightened on the container such that the liner is compressed slightly between the container body and the top interior surface of the closure. A sealing area is formed where the retort liner is compressed or sandwiched between the closure and the container lip. When the sealed container is exposed to retort conditions, the seal integrity is challenged by the pressure increases within the container.

In view of the conditions the retort liner is subjected to, specialized compositions of the present invention have been developed to include various properties desirable for a retort liner. Retort liners of the invention have a desirable hardness or durometer value in order to provide a resistance to permanent indentation or deformation that can cause failure of the seal. Retort liners also desirably have low compression set under retort conditions as well as good adhesion to the closure utilized. The retort liners also desirably have low compression set at room temperature. The retort liners also desirably have good adhesion to the plastics cap. It is further important that the retort liner have good melt flow in order to form a desired retort liner such as when utilizing compression molding and/or injection molding. The retort liners also are required to act as a barrier to oxygen in preferred applications.

Retort liners 20 of the present invention are formed from compositions including one or more styrenic block copolymers, one or more polyolefins, one or more softeners, and optionally but preferably, one or more lubricants. In a preferred embodiment, two or more styrenic block copolymers are present. In an additional embodiment, two or more polyolefins are present and include distinct melt flow indices. In an additional embodiment, two or more softener oils are present when the first styrenic block copolymer is styrene-ethylene/butylene-styrene (SEBS) and the second styrenic block copolymer is styrene-isobutylene-styrene (SIBS).

The retort liner compositions of the present invention include one or more styrenic block copolymers having a hard block (A) including aromatic vinyl repeat units and at least one soft polymer block (B) including two or more repeat units, that are the same or different, independently derived from one or more of an olefin monomer and a diene monomer. In one preferred embodiment, two or more styrenic block copolymers are present in the retort liner. The styrenic block copolymer is preferably hydrogenated. The styrenic block copolymer can be, for example, a triblock copolymer (A-B-A); or a tetrablock or higher multiblock copolymer. In a preferred embodiment, the styrenic block copolymer is a triblock copolymer (A-B-A) having two hard blocks.

Each hard polymer block (A) can have two or more same or different aromatic vinyl repeat units. For example, the block copolymer may contain (A) blocks which are styrene/alpha-methylstyrene copolymer blocks or styrene/butadiene random or tapered copolymer blocks so long as a majority of the repeat units of each hard block are aromatic vinyl repeat units. The (A) blocks are preferably aromatic vinyl compound homopolymer blocks. The term "aromatic vinyl" is to include those of the benzene series, such as styrene and its analogs and homologs including o-methylstyrene, p-methylstyrene, p-tert-butylstyrene, 1,3-dimethylstyrene, alpha-methylstyrene and other ring alkylated styrenes, particularly ring-methylated styrenes, and other monoalkenyl polycyclic aromatic compounds such as vinyl naphthalene, vinyl anthracene and the like. The preferred aromatic vinyl compounds are monovinyl monocyclic aromatics, such as styrene and alpha-methylstyrene, with styrene being most preferred. When three or more different repeat units are present in hard polymer block (A), the units can be combined in any form, such as random form, block form and tapered form.

Optionally, the hard polymer block (A) can comprise small amounts of structural units derived from other copolymerizable monomers in addition to the structural units derived from the aromatic vinyl compounds. The proportion of the structural units derived from other copolymerizable monomers is desirably 30% by weight or less and preferably 10% by weight or less based on the total weight of the hard polymer (A). Examples of other copolymerizable monomers include, but are not limited to, 1-butene, pentene, hexene, conjugated dienes such as butadiene or isoprene, methyl vinyl ether, and other monomers.

The soft polymer block (B) of the styrenic block copolymer comprises one or more and preferably two or more, same or different, structural units. Soft polymer block (B) can be derived from monomer units including one or more of a conjugated diene monomer and an olefin monomer. The olefin monomers generally have from 2 to about 12 carbon atoms and include, for example, ethylene, propylene, butylene, isobutylene, etc. The conjugated diene monomers preferably contain from 4 to about 8 carbon atoms with examples including, but not limited to, 1,3-butadiene (butadiene), 2-methyl-1,3-butadiene (isoprene), 2,3-dimethyl-1,3-butadiene, 1,3-pentadiene (piperylene), 1,3-hexadiene, and the like. When the soft polymer block (B) has structural units derived from three or more repeat units, the structural units may be combined in any form such as random, tapered, block or any combination thereof. In a preferred embodiment, the soft polymer block does not contain any unsaturated bonds.

The styrenic block copolymers may be prepared, for example, using free-radical, cationic and anionic initiators, or polymerization catalysts. Such polymers may be prepared utilizing bulk, solution or emulsion techniques as known in the art.

In a preferred embodiment, the unsaturated double bonds in the soft polymer block (B) of the styrenic block copolymer, if present, are hydrogenated. The hydrogenation ratio is generally 60% by mole or more, desirably 80% by mole or more, and preferably 100% by mole. In general, the hydrogenation may be accomplished using any of the numerous hydrogenation processes known to those of ordinary skill in the art. In a preferred embodiment, the amount of hard block ranges from about 10% to about 40% by weight based on the total weight of the styrenic block copolymer.

Optionally, the soft polymer block (B) can include small amounts of structural units derived from other copolymerizable monomers in addition to the structural units described. In this case, the proportion of the other copolymerizable monomers is generally 30% by weight or less, and preferably 10% by weight or less based on the total weight of the soft polymer block (B) of the styrenic block copolymer. Examples of other copolymerizable monomers include, for example, styrene, p-methylstyrene, α-methylstyrene, and other monomers that can undergo ionic polymerization.

Optionally, the styrenic block copolymer can be a functionalized styrenic block copolymer. An example of a functionalized styrenic block copolymer is a styrenic block copolymer having a reactive or crosslinkable hard block including aromatic vinyl repeat units. The hard block generally has at least one of an alkylstyrene-derived functional group or structural unit having at least one alkyl group containing 1 to 8 carbon atoms combined with the benzene ring, and/or an aromatic vinyl monomer unit having a functional group, and at least one soft polymer block comprising two or more repeat units, that are the same or different, derived from one or more monomers, such as an olefin monomer, preferably having from 2 to about 12 carbon atoms, such as ethylene, propylene or butylene, or a diene, such as butadiene or isoprene, or a combination thereof.

In a preferred embodiment, styrenic block copolymers are styrene-ethylene/butylene-styrene, and styrene-isobutylene-styrene block copolymers, such as known in the art as SEBS, and SIBS block copolymers. Styrenic block copolymers are available in the art from sources such as Kraton Polymers of Houston, Tex. Suitable styrenic block copolymers are available from Kraton Polymers under the Trade Name KRATON® G1651H, which is a linear copolymer based on styrene and ethylene/butylene with a polystyrene content of about 30%, KRATON® G1641H, KRATON® MD6933, and as KRATON® MD6945 with a polystyrene content of about 13%.

In various embodiments of the present invention, it is desirable to utilize two or more styrenic block copolymers to form a portion of a retort liner. It has been found that it is desirable to include a SEBS block copolymer having a relatively high melt viscosity in order to impart good compression set values to the retort liner. It is further desirable to utilize an additional styrenic block copolymer such as a lower melt viscosity SEBS block copolymer to reduce the viscosity, or a SIBS block copolymer which aids in reducing viscosity of the composition as well as improving barrier properties of the liner, or a combination thereof. Optionally, a functionalized styrenic block copolymer can be included in any of the above described blends of styrenic block copolymers or utilized alone with the relatively high melt viscosity SEBS styrenic block copolymer.

When one SEBS block copolymer is used, its preferred melt viscosity is preferably greater than or equal to 60,000 Pa·s as measured at 230° C. at a shear rate of 4.6 1/s. When two or more SEBS block copolymers are used in some embodiments, at least one SEBS styrenic block copolymer has a melt viscosity at least 60,000 Pa·s or higher as measured at 230° C. at a shear rate of 4.6 1/s, and a second SEBS styrenic block copolymer has a melt viscosity less than 60,000 Pa·s as measured at 230° C. at a shear rate of 4.6 1/s. The amount of the second SEBS block copolymer is preferably from about 1 to about 30 parts per 100 parts of the first high melt viscosity SEBS block copolymer. In the indicated amounts, the second SEBS block copolymer reduces melt viscosity without substantially affecting the desired hardness of the liner.

In one preferred embodiment of the present invention, at least two different styrenic block copolymers are utilized, with each block copolymer contributing a desired effect to the overall composition of the retort liner. In one embodiment, the at least two different styrenic block copolymers are distinguished via melt viscosity measured at 230° C. wherein at least one relatively high molecular weight, high melt viscosity styrenic block copolymer, preferably a SEBS block copolymer, and at least one relatively low molecular weight, low melt viscosity styrenic block copolymer, preferably a SIBS block copolymer, are present in the retort liner. The high molecular weight, high melt viscosity SEBS block copolymer has a melt viscosity generally greater than or equal to 60,000 Pa·s at 4.6 1/s at 230° C., desirably at least 62,500 Pa·s at 4.6 1/s at 230° C. and preferably at least 65,000 Pa·s to about 100,000 Pa·s at 4.6 1/s at 230° C. The molecular weight of the second styrenic block copolymer, preferably SIBS, has a melt viscosity lower than the lowest melt viscosity of the first high molecular weight styrenic block copolymer, and generally from about 700 or about 900 Pa·s to less than 60,000 Pa·s at 4.6 1/s at 230° C., desirably from about 10,000 Pa·s to about 21,000 Pa·s at 4.6 1/s at 230° C., and preferably from about 10,000 Pa·s to about 14,000 Pa·s at 4.6 1/s at 230° C. The high melt viscosity styrenic block copolymers are utilized to impart desirable compression set to the retort liner. It is desirable to have the retort liner resist permanent deformation after release of a compressive stress, such as provided when the liner is pressed between the closure and container body. However, high melt viscosity styrenic block copolymers can be difficult to process due to the relatively high viscosity. The low melt viscosity styrenic block copolymer has been found to increase melt flow of the retort liner composition during processing to form the retort liner and thereby also reduce viscosity. Adding a low melt viscosity styrenic block copolymer further aids in maintaining a desired hardness of the composition. Surprisingly, it still imparts an acceptable compression set for the retort application. The low melt viscosity styrenic block copolymer SIBS can also improve the oxygen barrier properties of the retort liner.

In an embodiment where a SIBS styrenic block copolymer is present, the SIBS styrenic block copolymer is present in an amount from about 0 to about 40 parts, desirably from about 10 to about 40 parts, and preferably from about 10 to about 30 parts based on 100 total parts by weight of the total styrenic block copolymer content. In one embodiment, the high molecular weight, high melt viscosity styrenic block copolymer comprises a styrene-ethylene-butylene-styrene (SEBS) copolymer and the low molecular weight styrenic block copolymer comprises a styrene-isobutylene-styrene block copolymer (SIBS). In another embodiment, the high molecular weight, high melt viscosity styrenic block copolymer comprises a SEBS and the low molecular weight, low melt viscosity is a mixture of SIBS block copolymer and a low molecular weight, low melt viscosity SEBS block copolymer.

In another embodiment, the styrenic block copolymer is a mixture of high melt viscosity SEBS block copolymer and a functionalized SEBS block copolymer. Optionally, other styrenic block copolymers can also be present, such as the low melt viscosity SEBS or SIBS, or both. The functionalized SEBS polymers are preferably SEBS polymers with maleic anhydride (MA) grafted onto the rubber midblock. The amount of MA grafted onto the block copolymer is from 0.5% to 2.0%, preferably from 1.0 to 1.7 wt. % based on the total weight of the functionalized styrenic block copolymer present. The amount of functionalized SEBS, preferably MA-SEBS, when present is from about 1 to about 50% by weight of the total styrenic block copolymer present in the composition. Surprisingly, the MA grafted SEBS block copolymer along with SIBS block copolymer, according to this invention, improves the adhesion to a plastic closure, such as polyester. MA-modified SEBS block copolymers are available as Kraton MD6684CS and Kraton FG 1901 from Kraton Company.

The retort liner compositions of the present invention include one or more of a polyolefin polymer and a polyolefin copolymer, herein also collectively referred to as a (co)polymer. In one preferred embodiment, the retort liners include two or more different polyolefin (co)polymers, preferably having a melt index difference greater than at least 4 and preferably greater than at least 8 grams of polymer per 10 minutes of flow time measured according to ASTM D1238. Polyolefins suitable for use in the compositions of the present invention comprise amorphous or crystalline homopolymers or copolymers of two or more different monomers derived from alpha-monoolefins having from 2 to about 12 carbon atoms, and preferably from 2 to about 8 carbon atoms. Examples of suitable olefins include ethylene, propylene, 1-butene, 1-pentene, 1-hexene, 2-methyl-1-propene, 3-methyl-1-pentene, 4-methyl-1-pentene, 5-methyl-1-hexene, and combinations thereof. Polyolefins include, but are not limited to, low-density polyethylene, high-density polyethylene, linear-low-density polyethylene, polypropylene (isotactic and syndiotactic), ethylene/propylene copolymers, polybutene, and olefinic block copolymers. Polyolefin copolymers can also include the greater part by weight of one or more olefin monomers and a lesser amount of one or more non-olefin monomers such a diene monomer, EPDM, etc. Generally, a polyolefin copolymer includes less than 50 weight percent of a non-olefin monomer, desirably less than 30 weight percent, and preferably less than about 10 weight percent of a non-olefin monomer.

Polyolefins utilized in the present invention are chosen so as to have sufficient ability to flow under pressure and can relatively easily aid in forming retort liners in the molten state, but also allow the final composition to have sufficient mechanical strength. Polyolefins also aid in reducing viscosity of compositions thereby improving the processability and processing equipment utilized to form the retort liners. Furthermore, polyolefins also improve adhesion of the liner to the cap substrate, especially when polypropylene is used as the cap.

In a preferred embodiment of the present invention, at least two or at least three different polyolefin (co)polymers are utilized in the retort liner, wherein the polyolefins have different melt indexes. Low melt index polyolefins are utilized to improve tensile strength and high melt index polyolefins are utilized to improve processability. A high melt index polyolefin has a melt index generally greater than 8, desirably greater than 10, and preferably greater than 12 to about 40 grams of polymer per 10 minutes. Low melt index polyolefins have a melt index less than the lowest melt index of the high melt index polyolefin (co)polymers, and ranges generally from about 0.4 to about 6 or 8, desirably from about 0.8 to about 5 and preferably from about 2 to about 4 grams of polymer per 10 minutes. In one embodiment, three or more polyolefins are utilized having different melt indexes, for example a low melt index polyolefin having a melt index from about 1 to about 8, a high melt index polyolefin having a melt index greater than 8 to 15, and a high melt index polyolefin having a melt index greater than 15 to about 40 grams of polymer per 10 minutes. Melt flow index when utilized herein is measured according to ASTM D1238.

Of the olefinic (co)polymers, polypropylene and polyethylene are desirable. Polypropylene is preferred at least in part due to ease of molding and processability, resistance to chemicals, cost, and imparting mechanical properties.

Polyolefin polymers and copolymers are commercially available from sources including, but not limited to, Chevron, Dow Chemical, DuPont, Exxon Mobil, Huntsman Polymers, Ticona and Westlake Polymer under various designations.

The total amount of the polyolefin polymer or copolymer can be utilized in the compositions of the present invention in an amount generally from about 1 to about 60 parts, desirably from about 30 to about 55 parts, and preferably from about 40 to about 52 parts, based on 100 parts by weight of the total styrenic block copolymer(s) present. When two or more polyolefin polymers or copolymers having different melt indexes are present in the retort liners, the low melt index polyolefin (co)polymer is present in an amount from about 35 to about 55, desirably from about 40 to about 50, and preferably from about 45 to about 50 based on 100 total parts by weight of the polyolefin (co)polymers present, i.e. one or more low melt index and one or more high melt index polyolefin (co)polymers. Polyethylene, when present, can be used in an amount from about 1 to about 20 parts per 100 parts of total styrenic block copolymer. Mixtures of polyethylene and polypropylene are utilized in some embodiments.

A retort liner of the present invention preferably includes a softener such as a mineral oil softener, or synthetic resin softener, or combinations thereof. The softener can beneficially reduce the temperatures at which the compositions are processable. Oil softeners are generally mixes of aromatic hydrocarbons, naphthene hydrocarbons and paraffin, i.e., aliphatic, hydrocarbons. Those in which carbon atoms constituting paraffin hydrocarbons occupy 50% by number or more of the total carbon atoms are called "paraffin oils". Those in which carbon atoms constituting naphthene hydrocarbons occupy 30 to 45% by number of the total carbon atoms are called "naphthene oils", and those in which carbon atoms constituting aromatic hydrocarbons occupy 35% by number or more of the total carbon atoms are called "aromatic oils".

In one embodiment, paraffin oils and/or plasticizers are preferably utilized as a softener in compositions of the present invention. The softener is preferably an aliphatic oil, or a polyisobutylene oil or a mixture of these two oils in one embodiment. The softeners generally have up to about 28 carbon atoms. The softener, when present, is utilized in an amount generally from about 80 to about 150 parts by weight, and preferably from about 90 to 140 parts by weight per 100 total parts by weight of the styrenic block copolymer of the retort liner. In a preferred embodiment, the retort liners are substantially free of silicone oil and preferably free of silicone oil. In a further preferred embodiment, the retort liners are free of oils having a molecular weight of greater than 1,000 weight average.

If desired, the retort liners of the present invention may include lubricants, light stabilizers, pigments, heat stabilizers, processing aids, mold release agents, flow enhancing agents and non-platelet fillers. The retort liners of the present invention are free of polyphenylene ether in a preferred embodiment. Examples of inorganic fillers for use in the compositions of the present invention include, but are not limited to, one or more of calcium carbonate, clay, silica and kaolin. The optional components, independently, can be utilized within ranges not adversely affecting the performance of the compositions. All additives should be screened for compatibility with the base formulation to insure that they are FDA approved for use in direct food contact.

The retort liners of the present invention formulated comprising the components hereinabove have a hardness that ranges generally from about Shore A 50 to about Shore A 80 according to ASTM D-2240. The retort liners also have low compression set under a retort condition. For example, the compression set is less than 80% at 121° C. for two hours. The formulation of the retort liners allows for good adhesion to a plastics closure, preferably a polypropylene thermoplastic closure. Retort liners also have good tensile properties and compositions described hereinabove provide excellent ability to both compression mold and injection mold retort liners. Retort liners also provide a reasonable good oxygen barrier which is a requirement of a retort liner to prevent ingress or egress of fluids into or out of the container.

As indicated herein, the closure is designed to form a seal with a container body, with the retort liner being disposed therebetween. In a preferred embodiment, the closure is a thermoplastic or thermoset material. In a preferred embodiment, the closure is a thermoplastic and comprises one or more of a polyolefin and a polyester. Suitable polyolefins have been described hereinabove with respect to the retort liner. Examples of suitable polyesters include polyethylene terephthalate (PET) and polyethylene naphthalate. Preferred materials for the closure are those thermoplastics approved by the FDA for contact with food or foodstuffs. The polymeric material utilized for the closure must be able to withstand the retort processing conditions.

The container body may be manufactured from a wide variety of materials such as known in the art for container use. Preferably the container is a rigid or semi-rigid polymeric material, either thermoplastic or thermoset, that can withstand the retort processing conditions. Preferred materials for the container body are those thermoplastics approved by the FDA for contact with food or foodstuffs. In a preferred embodiment, the container body is a thermoplastic and comprises one or more of a polyolefin and polyester. Examples of suitable polyesters include polyethylene terephthalate (PET) and polyethylene naphthalate.

EXAMPLES

The formulations set forth in the following Tables were prepared by melt mixing the indicated components using a Banbury internal mixer. The properties were measured using injection molded samples prepared from the respective formulations.

TABLE 1

| Composition/Test Method | Example 1 | Example 2 | Example 3 |
|---|---|---|---|
| SEBS[1] | 100 | 80 | 70 |
| Processing oil[2] | 130.36 | 130.36 | 130.36 |
| Polypropylene 20 MI | | 25.89 | 25.89 |
| Polypropylene 12 MI | 25.89 | 0 | 0 |
| Polypropylene 4 MI | 25.89 | 25.89 | 25.89 |
| SIBS[3] | 0 | 20 | 30 |
| Lubricant[4] | 3 | 3 | 3 |
| Lubricant[5] | 1.45 | 1.45 | 1.45 |
| Heat stabilizer[6] | 0.3 | 0.3 | 0.3 |
| TOTAL | 286.89 | 286.89 | 286.89 |
| Melt index (g) | 14 | 50 | 72 |
| Specific gravity | 0.89 | 0.89 | 0.89 |
| Shore A Hardness instant | | 69 | 65 |
| Shore A Hardness, 5 seconds delay | 62 | 60 | 57 |
| CS = Compression Set | | | |
| CS %, 121° C. for 2 hrs. | 53 | 57.5 | 59.8 |
| CS %, 50° C. for 22 hrs. | 32 | 40.4 | 44.3 |
| CS %, 23° C. for 22 hrs. | 22 | 24.7 | 26.3 |
| Tensile Strength, PSI | 1600 | 1209 | 1040 |
| % Elongation | 800 | 767 | 684 |
| Oxygen permeability, cm3-mm/[m2-d-atm] | 6100 | 4764 | 4677 |

[1]Styrene-ethylene-butylene-styrene block copolymer, melt viscosity 68,000 Pa · s at a shear rate of 4.6 1/s at 230° C.
[2]Semtol 500
[3]Styrene-isobutylene-styrene block copolymer, melt viscosity 14,000 Pa · s at a shear rate of 4.6 1/s at 230° C.
[4]Crodamide ER (vegetable oil)
[5]Crodamide VR (vegetable oil)
[6]Irganox 1010

Example 1 in Table 1 shows a composition that does not contain a second styrenic block copolymer that has a lower melt viscosity. Examples 2 and 3 are the compositions that contain a lower melt viscosity styrenic block copolymer, SIBS. The melt index was improved, and the oxygen barrier property was also improved.

Example 4 in Table 2 shows a composition that contains three different styrenic block copolymers, a high melt viscosity SEBS styrenic block copolymer, a functionalized styrenic block copolymer, maleated SEBS, and a low melt viscosity styrenic block copolymer, SIBS. The composition exhibited desirable oxygen barrier properties.

TABLE 2

| Composition/Test Method | Example 4 |
|---|---|
| SEBS[1] | 70 |
| MA-SEBS[2] | 10 |
| SIBS[3] | 20 |
| Processing Oil[4] | 130 |
| Polypropylene 20 MI | 15.89 |
| Polypropylene 12 MI | 10 |
| Polypropylene 4 MI | 25.89 |
| Lubricant[5] | 3 |
| Lubricant[6] | 1.45 |
| Heat stabilizer[7] | 0.3 |
| TOTAL | 286.53 |
| Hardness, Shore A, instant | 68 |
| hardness, Shore A, 5 seconds delay | 64 |
| Specific Gravity | 0.982 |
| MI, 200° C./5 Kg | 66 |

TABLE 2-continued

| Composition/Test Method | Example 4 |
|---|---|
| CS = Compression Set | |
| CS %, 121° C.* 2 hrs. | 69 |
| CS %, 50° C.* 22 hrs. | 41 |
| CS %, 23° C.* 22 hrs. | 23 |
| Tensile strength, psi | 1220 |
| Elongation | 790 |
| Permeability, avg. cm3-mm/[m2-d-atm] | 3700 |

[1]Styrene-ethylene-butylene-styrene block copolymer, melt viscosity 68,000 Pa · s at a shear rate of 4.6 1/s at 230° C.
[2]Maleated Styrene-ethylene-butylene-styrene block copolymer, melt viscosity 65,000 Pa · s at a shear rate of 4.6 1/s at 230° C.
[3]Styrene-isobutylene-styrene block copolymer, melt viscosity 14,000 Pa · s at a shear rate of 4.6 1/s at 230° C.
[4]Semtol 500
[5]Crodamide ER (vegetable oil)
[6]Crodamide VR (vegetable oil)
[7]Irganox 1010

Further examples of retort liner compositions are set forth in Table 3. Example 5 includes the use of styrenic block copolymer that is maleic anhydride modified styrene-ethylene-butylene-styrene (MA-SEBS) that is utilized as a component for the retort liner. Polyolefins having three different melt indexes were also used to modify properties of the retort liner. Unexpectedly, the adhesion of a retort liner to a polyester substrate, particularly polyethylene terephthalate, can be improved.

TABLE 3

| Composition/Test Method | Example 5 |
|---|---|
| SEBS[1] | 40 |
| MA-SEBS[2] | 30 |
| SEBS[3] | 10 |
| SIBS[4] | 20 |
| Processing Oil[5] | 130 |
| Polypropylene 20 MI | 15.89 |
| Polypropylene 12 MI | 10 |
| Polypropylene 4 MI | 25.89 |
| Lubricant[6] | 3 |
| Lubricant[7] | 1.45 |
| Heat stabilizer[8] | 0.3 |
| TOTAL | 286.53 |
| Hardness, Shore A, instant | 65 |
| hardness, Shore A, 5 seconds delay | 58 |
| Specific Gravity | 0.895 |
| Adhesion to PET | good |
| MI, 200 C/5 Kg | 95.5 |
| CS = Compression Set | |
| CS %, 121° C.* 2 hrs. | 77 |
| CS %, 50° C.* 22 hrs. | 43 |
| CS %, 23° C.* 22 hrs. | 22 |
| Tensile, 20"/min | |
| tensile strength, psi | 1030 |
| Elongation | 780 |
| Permeability, avg. cm3-mm/[m2-d-atm] | 4956 |

[1]Styrene-ethylene-butylene-styrene block copolymer, melt viscosity 68,000 Pa · s at a shear rate of 4.6 1/s at 230° C.
[2]Maleated Styrene-ethylene-butylene-styrene block copolymer, melt viscosity 65,000 Pa · s at a shear rate of 4.6 1/s at 230° C.
[3]Styrene-ethylene-butylene-styrene block copolymer, melt viscosity 46,000 Pa · s at a shear rate of 4.6 1/s at 230° C.
[4]Styrene-isobutylene-styrene block copolymer, melt viscosity 14,000 Pa · s at a shear rate of 4.6 1/s at 230° C.
[5]Semtol 500
[6]Crodamide ER (vegetable oil)
[7]Crodamide VR (vegetable oil)
[8]Irganox 1010

In accordance with the patent statutes, the best mode and preferred embodiment have been set forth; the scope of the invention is not limited thereto, but rather by the scope of the attached claims.

What is claimed is:

1. A retort liner for use in sealing a retortable container, comprising:

at least two styrenic block copolymers, including a first styrenic block copolymer having a melt viscosity greater than or equal to 60,000 Pa·s at a shear rate of 4.6 1/s at 230° C. and a second styrenic block copolymer having a melt viscosity less than the first styrenic block copolymer, wherein the first and second styrenic block copolymers have at least one hard polymer block derived from at least two aromatic vinyl compound units, and at least one soft polymer block, wherein the soft polymer block includes at least one repeat unit derived from one or more of an olefin monomer and a diene monomer;

a softener;

one or more polyolefin (co)polymers; and wherein the retort liner has a hardness from Shore A 50 to Shore A 80 according to ASTM D-2240, and wherein the retort liner is a single layer in a form of a seal ring having an upper surface, lower surface and a diameter.

2. The retort liner according to claim 1, wherein the one or more polyolefin (co)polymers are derived from olefin monomers having from 2 to about 8 carbon atoms, wherein the one or more polyolefin (co)polymers comprise polyethylene and polypropylene, and wherein the retort liner is free of silicone oil and polyphenylene ether.

3. The retort liner according to claim 1, wherein at least the first styrenic block copolymer is a styrene-ethylene-butylene-styrene block copolymer, wherein the softener is present in an amount from about 80 to about 150 parts based on 100 total parts by weight of the styrenic block copolymers, and wherein one or more polyolefin (co)polymers are present in an amount from about 1 to about 55 parts based on 100 parts by weight of the total styrenic block copolymers.

4. The retort liner according to claim 3, wherein a styrene-isobutylene-styrene block copolymer is present in an amount from about 10 to 40 parts based on 100 parts by weight of the total styrenic block copolymers.

5. The retort liner according to claim 1, wherein two or more polyolefin (co)polymers are present, wherein the first polyolefin (co)polymer has a melt index of greater than 8 grams of polymer per 10 minutes measured according to ASTM D1238, and wherein the second polyolefin (co)polymer has a melt index that ranges from 0.4 to 8 grams of polymer per 10 minutes measured according to ASTM D1238.

6. The retort liner according to claim 1, wherein the first styrenic block copolymer has a melt viscosity greater than or equal to 60,000 to about 100,000 Pa—s at a shear rate of 4.6 1/s at 230° C., and wherein the second styrenic block copolymer has a melt viscosity of about 700 to 21,000 Pa·s at a shear rate of 4.6 1/s at 230° C.

7. The retort liner according to claim 6, wherein the first styrenic block copolymer is a styrene-ethylene-butylene-styrene block copolymer, and wherein the second styrenic block copolymer is a styrene-isobutylene-styrene block copolymer that is present in an amount from 10 to 40 parts based on 100 parts by weight of the total styrenic block copolymer.

8. The retort liner according to claim 6, wherein the retort liner further includes a functionalized styrenic block copolymer.

9. The retort liner according to claim 8, wherein the functionalized styrenic block copolymer is a maleic anhydride functionalized styrene-ethylene-butylene styrene block copolymer.

10. The retort liner according to claim 6, wherein two or more polyolefin (co)polymers are present, wherein the first polyolefin (co)polymer has a melt index of greater than 8 grams of polymer per 10 minutes measured according to ASTM D1238, and wherein the second polyolefin (co)polymer has a melt index that ranges from about 0.4 to 6 grams of polymer per 10 minutes measured according to ASTM D1238.

11. The retort liner according to claim 10, wherein the softener is present in an amount from about 80 to about 150 parts based on 100 total parts by weight of the styrenic block copolymers, and wherein the two or more polyolefin (co) polymers are present in a total amount of about 35 to about 55 parts based on 100 total parts by weight of the styrenic block copolymers, wherein the softener is an aliphatic oil, or polyisobutylene oil, or a mixture thereof.

12. The retort liner according to claim 3, wherein the second styrenic block copolymer is a styrene-ethylene-butylene-styrene block copolymer having a melt viscosity less than the first styrenic block copolymer.

13. The retort liner according to claim 12, wherein the second styrenic block copolymer is present in an amount from about 1 to about 30 parts based on 100 parts by weight of the total styrenic block copolymers present.

14. A retort liner for use in sealing a retortable container, comprising:

one or more styrenic block copolymers, wherein the one or more styrenic block copolymers each have at least one hard polymer block derived from at least two aromatic vinyl compound units and at least one soft polymer block, wherein the soft polymer block includes at least one repeat unit derived from one or more of an olefin monomer and a diene monomer;

two or more polyolefin (co)polymers in a total amount of from about 35 to about 55 parts based on 100 total parts by weight of the styrenic block copolymer, wherein the first polyolefin (co)polymer has a melt index greater than 8 grams of polymer per 10 minutes measured according to ASTM D1238, and wherein the second polyolefin (co)polymer has a melt index from about 0.4 to 8 grams of polymer per 10 minutes measured according to ASTM D1238; and a softener, wherein the retort liner is a single layer in a form of a seal ring having an upper surface, lower surface and a diameter.

15. The retort liner according to claim 14, wherein the first polyolefin (co)polymer has a melt index of 8 to about 40 grams of polymer per 10 minutes measured according to ASTM D1238, and wherein the second polyolefin (co)polymer has a melt index of about 0.8 to about 6 grams of polymer per 10 minutes measured according to ASTM D1238.

16. The retort liner according to claim 15, wherein the first and second polyolefin (co)polymers are each polypropylene.

17. The retort liner according to claim 14, wherein the two or more polyolefin (co)polymers are both derived from olefin monomers having from 2 to about 8 carbon atoms, and wherein the retort liner is free of silicone oil and polyphenylene ether, wherein the retort liner has a hardness from about Shore A 50 to Shore A 80 according to ASTM D-2240.

18. The retort liner according to claim 14, wherein at least two styrenic block copolymers are present, and wherein at least one of the styrenic block copolymers is a styrene-ethylene-butylene-styrene block copolymer.

19. The retort liner according to claim 18, wherein one or more of a styrene-isobutylene-styrene block copolymer and a second styrene-ethylene-butylene-styrene block copolymer are present.

20. The retort liner according to claim 19, wherein one of the at least two styrenic block copolymers has a melt viscosity greater than or equal to 60,000 to about 100,000 Pa·s at a shear rate of 4.6 1/s at 230° C., and wherein the styrene-isobutylene-styrene block copolymer is present in an amount from 10 to 40 parts based on 100 parts by weight of the total styrenic block copolymers and has a melt viscosity of about 700 to about 21,000 Pa·s at a shear rate of 4.6 1/s at 230° C., wherein the retort liner composition has a hardness from Shore A 50 to Shore A 80 according to ASTM D-2240.

21. The retort liner according to claim 18, wherein the retort liner further includes a functionalized styrenic block copolymer.

22. The retort liner according to claim 21, wherein the functionalized styrenic block copolymer is a maleic anhydride functionalized styrene-ethylene-butylene styrene block copolymer.

23. The retort liner according to claim 18, wherein the second styrenic block copolymer is present in an amount from about 1 to about 40 parts based on 100 total parts by weight of the total styrenic block copolymers present.

24. A retort liner for use in sealing a retortable container, comprising:

at least two styrenic block copolymers, including a first styrenic block copolymer having a melt viscosity greater than or equal to 60,000 Pa·s at a shear rate of 4.6 1/s at 230° C. and a second styrenic block copolymer having a melt viscosity less than the first styrenic block copolymer, wherein the first and second styrenic block copolymers have at least one hard polymer block derived from at least two aromatic vinyl compound units, and at least one soft polymer block, wherein the soft polymer block includes at least one repeat unit derived from one or more of an olefin monomer and a diene monomer;

two or more polyolefin (co)polymers in a total amount of from about 35 to about 55 parts based on 100 total parts by weight of the styrenic block copolymer, wherein the first polyolefin (co)polymer has a melt index greater than 8 grams of polymer per 10 minutes measured according to ASTM D1238, and wherein the second polyolefin (co)polymer has a melt index from about 0.4 to 8 grams of polymer per 10 minutes measured according to ASTM D1238; and a softener, wherein the retort liner has a hardness from Shore A 50 to Shore A 80 according to ASTM D-2240, and wherein the retort liner is a single layer in a form of a seal ring having an upper surface, lower surface and a diameter.

25. The retort liner according to claim 24, wherein the first styrenic block copolymer is a styrene-ethylene-butylene-styrene block copolymer, wherein the softener is present in an amount from about 80 to about 150 parts based on 100 total parts by weight of the styrenic block copolymers.

26. The retort liner according to claim 24, wherein the first styrenic block copolymer is a styrene-ethylene-butylene-styrene block copolymer, and wherein the second styrenic block copolymer is a styrene-isobutylene-styrene block copolymer that is present in an amount from 10 to 40 parts based on 100 parts by weight of the total styrenic block copolymer.

27. The retort liner according to claim 26, wherein the second styrenic block copolymer is present in an amount from 10 to about 30 parts based on 100 parts by weight of the total styrenic block copolymers present.

28. The retort liner according to claim 24, wherein the first polyolefin (co)polymer has a melt index of greater than 12 to about 40 grams of polymer per 10 minutes measured according to ASTM D1238, and wherein the second polyolefin (co)polymer has a melt index of about 0.8 to about 6 grams of polymer per 10 minutes measured according to ASTM D1238.

29. The retort liner according to claim 24, wherein the first styrenic block copolymer is a styrene-ethylene-butylene-styrene block copolymer, and wherein the second styrenic block copolymer is a styrene-isobutylene-styrene block copolymer that is present in an amount from 10 to 40 parts based on 100 parts by weight of the total styrenic block copolymers, wherein the first polyolefin (co)polymer has a melt index of 8 to about 40 grams of polymer per 10 minutes measured according to ASTM D1238, and wherein the second polyolefin (co)polymer has a melt index of about 0.8 to about 6 grams of polymer per 10 minutes measured according to ASTM D1238.

30. The retort liner according to claim 24, wherein the retort liner has a rim extending around a peripheral edge of the liner.

* * * * *

UNITED STATES PATENT AND TRADEMARK OFFICE

CERTIFICATE OF CORRECTION

PATENT NO. : 7,960,007 B2
APPLICATION NO. : 12/218098
DATED : June 14, 2011
INVENTOR(S) : Biing-Lin Lee It is certified that error appears in the above-identified patent and that said Letters Patent is hereby corrected as shown below:

In claim 6, column 16, line 49, please delete "Pa—s" and replace with --Pa•s--.

In claim 24, column 18, line 26, delete "." after the "C".

Signed and Sealed this
Thirteenth Day of September, 2011

David J. Kappos

David J. Kappos
*Director of the United States Patent and Trademark Office*